US009617765B1

(12) United States Patent
Lawrence

(10) Patent No.: US 9,617,765 B1
(45) Date of Patent: Apr. 11, 2017

(54) WINDOW SASH AUTOLOCK AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 161 days.

(21) Appl. No.: 14/165,741

(22) Filed: Jan. 28, 2014

(51) Int. Cl.
*E05C 1/12* (2006.01)
*E05C 1/00* (2006.01)

(52) U.S. Cl.
CPC ..... *E05C 1/002* (2013.01)

(58) Field of Classification Search
CPC ..... E05B 63/20; E05B 17/22; Y10T 292/54; Y10T 292/546; Y10S 292/47; Y10S 292/20; E05Y 2900/148; E05F 2700/04
USPC ..... 292/DIG. 7, DIG. 20, DIG. 47
See application file for complete search history.

(56) References Cited

U.S. PATENT DOCUMENTS 1,489,588 A * 4/1924 Billings ..... E05B 63/20 292/333
2,490,197 A * 12/1949 Beder ..... E05B 63/20 292/332
4,262,504 A * 4/1981 Inoue ..... E05B 47/0002 292/144
6,764,115 B1 * 7/2004 Speed ..... E05B 63/20 292/158
8,333,413 B2 12/2012 Bourgoin et al. ..... 292/164
2008/0179896 A1 * 7/2008 Chung ..... E05B 63/20 292/164
2009/0127872 A1 * 5/2009 Ye ..... E05B 65/0864 292/241
2010/0207403 A1 * 8/2010 Bourgoin ..... E05B 63/20 292/335
2011/0248516 A1 * 10/2011 Liang ..... E05B 1/0038 292/173
2011/0298225 A1 12/2011 Liang et al. ..... 292/175
2012/0235424 A1 9/2012 Zhang ..... 292/29
2013/0111819 A1 5/2013 Tremble et al. ..... 49/449

OTHER PUBLICATIONS

One page printout from Interlock USA website showing the original Pro-Latch; copyright date 2009, Interlock USA, Inc.

* cited by examiner

*Primary Examiner* — Mark Williams
(74) *Attorney, Agent, or Firm* — Tuggle Duggins P.A.; Blake Hurt

(57) ABSTRACT

An automatically locking sash lock for a double-hung window including a handle and cover affixed to the exterior of a lock housing that contains a bolt and a pair of plungers, each of which defines at least one end with a biased face. The bolt and plungers are in mechanical communication through a pair of couplings that define a longitudinal groove for receiving the plunger and a finger for engaging the bolt. A method of locking a window is also provided.

15 Claims, 5 Drawing Sheets

WINDOW SASH AUTOLOCK AND METHOD

FIELD OF THE INVENTION

The invention herein pertains to window hardware and particularly pertains to an automatically locking window sash lock that locks upon returning to a keeper without any user input.

DESCRIPTION OF THE PRIOR ART AND OBJECTIVES OF THE INVENTION

Increased popularity of double hung windows has led to a corresponding increase in the number of options available for the window locks that accompany them. The traditional rotatable window latch is typically mounted on the lower sash of a double hung window and includes a cam that rotates into or out of engagement with an associated keeper when the handle is engaged. A downside to these latches is that the handle may be rotated when the cam is not positioned proximate the keeper. If the window is closed while the cam is extended, the window may be prevented from closing fully. In addition to potentially damaging the sash, this malfunction may cause loss of heated or cooled air and present a significant security concern for a home or business owner. Other lock designs such as sliding latch bolts require a high degree of dexterity to use, involve numerous parts, are generally expensive to install and maintain, and suffer the same alignment concerns which plague rotatable locks.

Other embodiments of similar latches utilize a plurality of threaded fasteners that are aesthetically unappealing, particularly when attached to the sash through the top of the lock housing or in combination with a base plate. Still other embodiments rely on housings that frictionally engage a base plate instead of utilizing fasteners, potentially in a "snap on" engagement. These locks tend to absorb vibration and transfer the energy from the base plate to the lock, causing the frictional engagement to fail and allowing the locks to disassociate from their respective base plates (i.e. "popping off").

Thus, in view of the problems and disadvantages associated with prior art window locks, the present invention was conceived and one of its objectives is to provide an autolocking sash lock capable of engaging a keeper without user urging.

It is another objective of the present invention to provide a sash lock with a bolt for engaging a keeper in cooperative communication with a plunger.

It is still another objective of the present invention to provide a sash lock with a bolt in cooperative communication with a pair of plungers via a pair of couplings.

It is yet another objective of the present invention to provide a sash lock with a handle in communication with a bolt that need only be manually urged to release the bolt from a keeper.

It is a further objective of the present invention to provide an autolocking sash lock with a coupling defining a groove with a biased face for engaging a plunger.

It is still a further objective of the present invention to provide a sash lock with a coupling defining a finger for frictionally engaging a bolt for urging the bolt between extended and retracted positions.

It is yet a further objective of the present invention to provide a keeper with biased faces that correspond to the biased faces of the plunger and bolt, respectively.

It is a further objective of the present invention to provide an aesthetically pleasing autolock that conceals the threaded fasteners without losing the structural benefit of the fastener.

It is another objective of the present invention to provide a method of securing a window with an autolocking sash lock that engages a keeper upon closing without user input.

It is a further objective of the present invention to provide a method of securing a window with an autolocking sash lock that utilizes biasing members to move a bolt and plunger from a first position to a second position.

Various other objectives and advantages of the present invention will become apparent to those skilled in the art as a more detailed description is set forth below.

SUMMARY OF THE INVENTION

The aforesaid and other objectives are realized by providing an automatically locking sash lock and associated keeper positioned in respectively opposing relation on the upper rail of a lower sash and the lower rail of an upper sash. The lock housing contains a bolt and a pair of plungers in cooperative communication via a pair of couplings. The plungers each define a pair of opposing ends that define one or more biased faces and each include a resilient member mounted thereon. The ends of each plunger are oriented perpendicularly in relation to the opposing end, for example the face of one end defining a horizontal bias while the face of the opposing end defines a vertical bias. The bolt defines an end with a biased face and two pairs of notches in opposing relation defined in parallel sides. The bolt further includes a channel formed between the parallel sides in the end opposite the biased face end for containing a resilient member therein. The couplings each define a groove in one end with a biased face sized to receive one of the plunger ends and a finger on one side for engaging one of the pairs of notches defined by the bolt. On the opposite side of the coupling a groove is formed in each of the couplings for containing a resilient member therein. A handle defines a pair of downwardly depending legs that protrude through the lock housing for engaging the bolt.

A user can manually urge the handle away from the lock housing, causing the bolt to retract in addition to providing an auditory or tactile response. As the bolt retracts within the housing and clears the keeper, which defines a plurality of apertures with biased faces to correspond with the biased plunger and bolt faces, the fingers on the couplings are dislodged from the pair of initial opposing shallow notches thus extending the couplings outwardly which allows the plungers to partially retract within the couplings by way of the biased faces to clear the keeper and allow the window to be opened. Upon full retraction of the bolt, the fingers on the couplings lodge within the next pair of opposing notches which are deeper thereby urging the plungers into a fully extended position, for example by biasing members, and locking the bolt in a retracted posture. Upon raising the lower sash of the window, the biased faces of the fully extended plungers are engaged by the keeper and slide therealong to retract the plungers thus pushing the biased ends along the couplings for retraction thereof causing release of the fingers from the deeper notches whereby the resilient member in the bolt forces the bolt outwardly to its original locking position.

When it is desired to close the window a user grasps the upper rail of the lower sash as conventional and pushes downwardly whereby the biased faces of the extended plungers and bolt engage and slide along the keeper until the plungers and bolt enter respective apertures in the keeper whereby the sash lock automatically locks without any additional input from a user.

A method of using the autolocking window sash lock and keeper described above includes the steps of providing a lock housing containing a bolt and a pair of plungers in communication via a pair of couplings and a handle engaging the bolt, manually engaging the handle, displacing the bolt, and urging the bolt and plungers forward to engage the associated keeper upon returning the window to a closed position.

DETAILED DESCRIPTION OF THE PREFERRED EMBODIMENT AND OPERATION OF THE INVENTION

Figure 1:
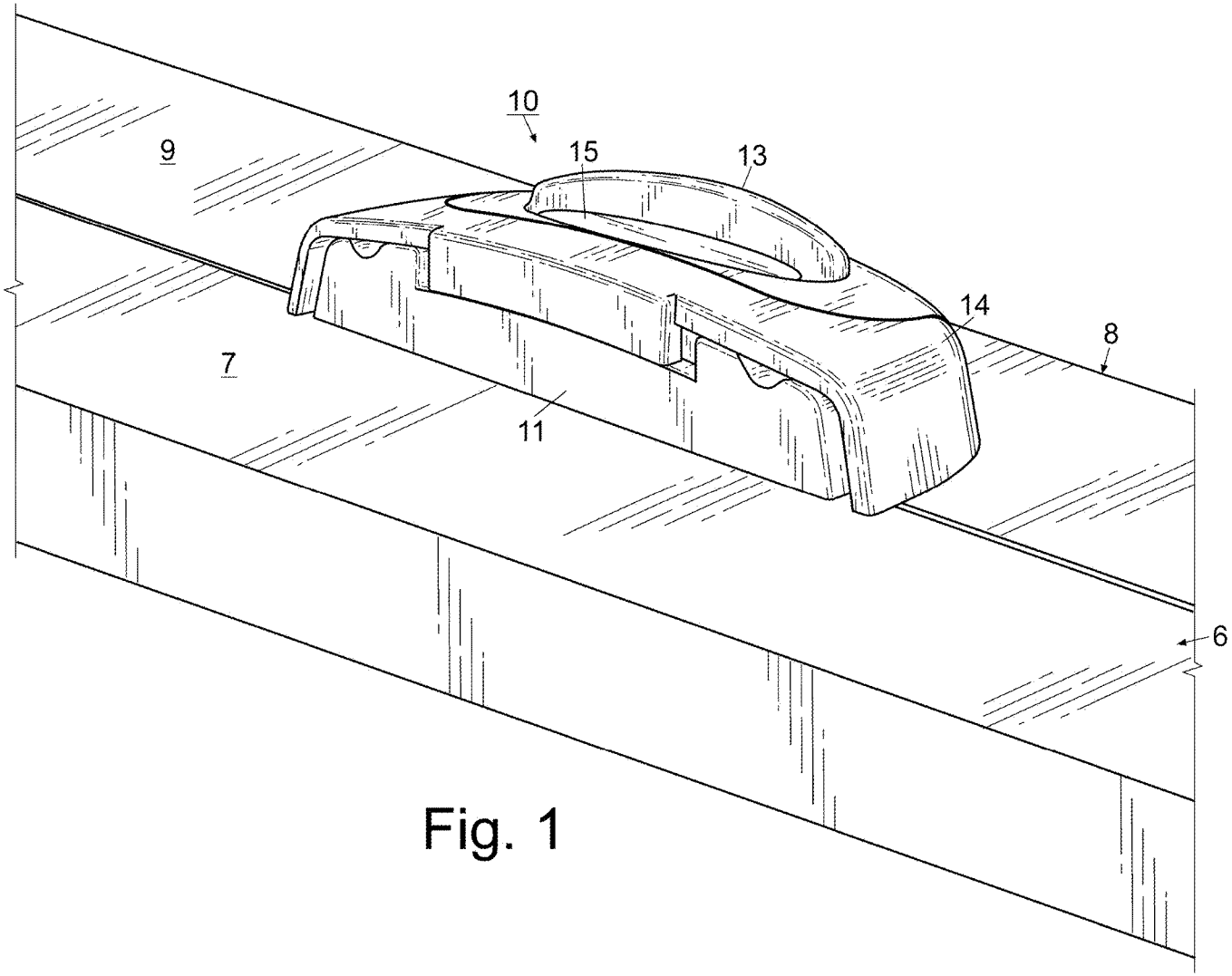
FIG. 1 shows a side perspective view of an autolocking window sash lock and keeper installed in a sash.

For a better understanding of the invention and its operation, turning now to the drawings, FIGS. 1-5 illustrate preferred autolocking sash lock 10 and associated keeper 11. Sash lock 10 may be positioned on upper rail 9 of lower sash 8 with keeper 11 positioned on lower rail 7 of upper sash 6 as would be understood within a conventional, double-hung window. Both sash lock 10 and keeper 11 may be affixed respectively to sashes 8, 6 by threaded fasteners 12, 12' in addition to other conventional attachment means attached utilizing lock 10, keeper 11, or base plate 42 such as adhesives, supportive feet inserted through holes routed into sashes 8, 6, frictionally-engaging studs and corresponding sash dimples, pre-drilled holes or the like.

Figure 2:
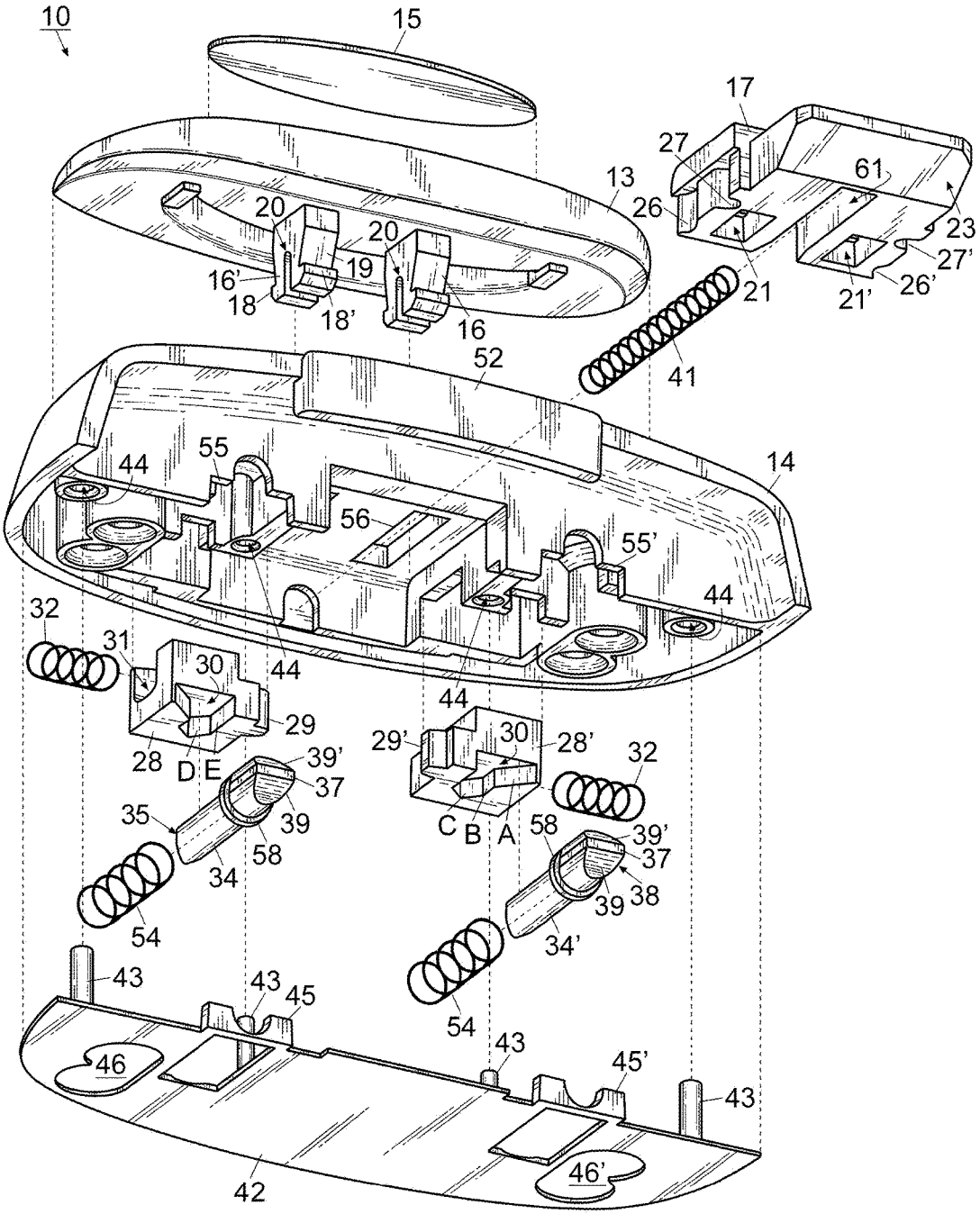
FIG. 2 pictures a side perspective exploded view of the sash lock of FIG. 1.

Preferred sash lock 10 illustrated in FIG. 2 is formed from a polymeric material such as nylon and includes handle 13 engaging the top of housing 14. In an embodiment of sash lock 10, housing 14 defines overhand lip 52 for engaging the top of keeper 11 and a recess sized to receive the circumference of handle 13 such that handle 13 forms a substantially seamless exterior surface with housing 14. Handle 13 is sized and positioned to conceal fasteners 12 and associated apertures 64 following installation of housing 14 on sash 8 and may also include cover 15 that displays indicia for advertising or the like (not shown). Handle 13 may include one or more downwardly depending (i.e. towards housing 14) legs 16, 16' that pass though apertures 56, 56' (FIG. 3) in housing 14 and frictionally engage bolt 17. Preferably, two legs 16, 16' each include leg body 19 having a pair of opposingly oriented lips 18, 18' with channel 20 formed therebetween, respectively. Lips 18, 18' of each of legs 16, 16' frictionally engage bolt 17 which is perpendicularly positioned with respect to leg bodies 19. Leg body 19 may each define channel 20 for receiving bolt post 22 therein.

Figure 3:
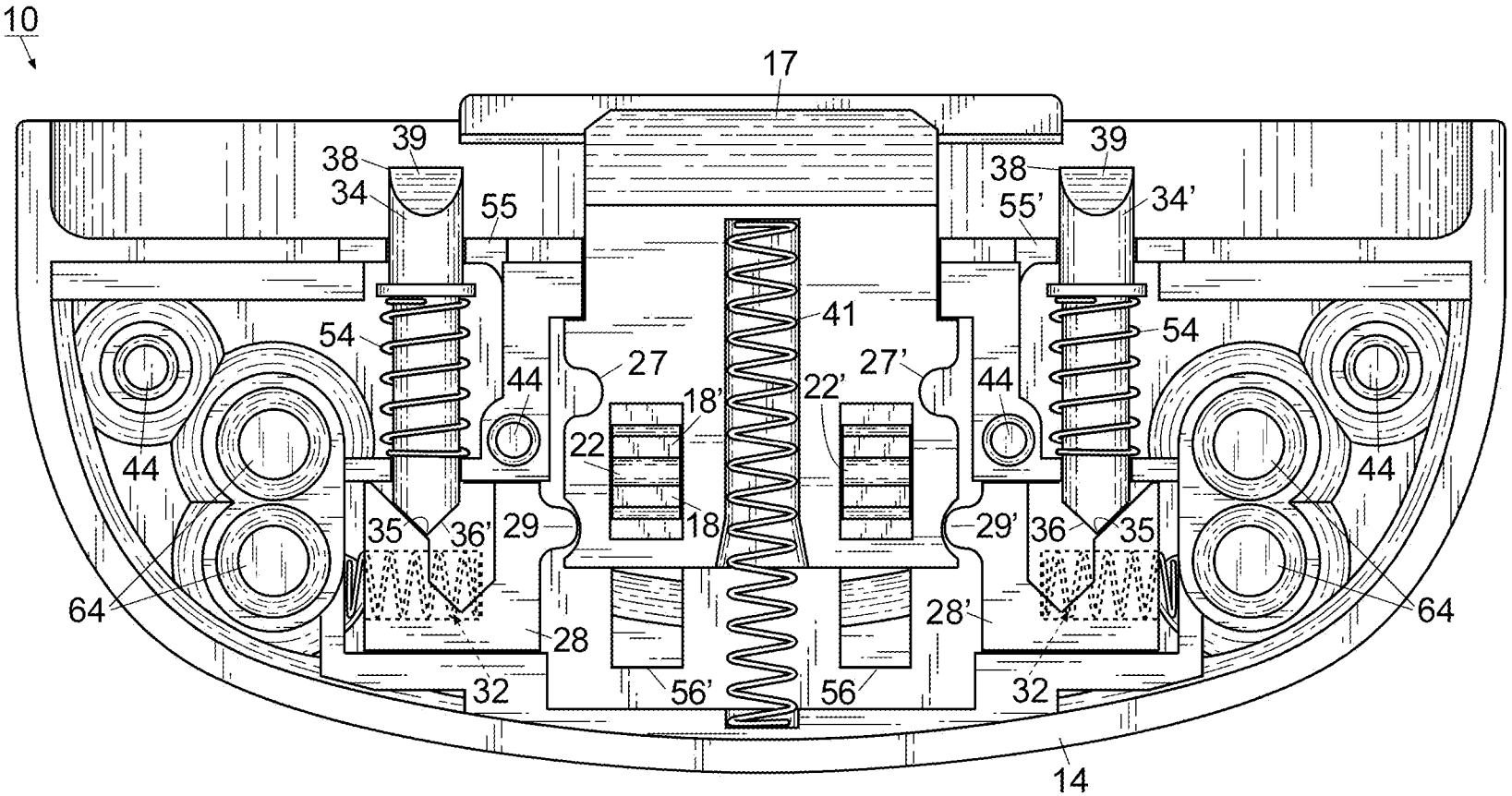
FIG. 3 depicts a bottom plan view of the sash lock of FIG. 1 in an extended orientation with the base plate removed.
Figure 4:
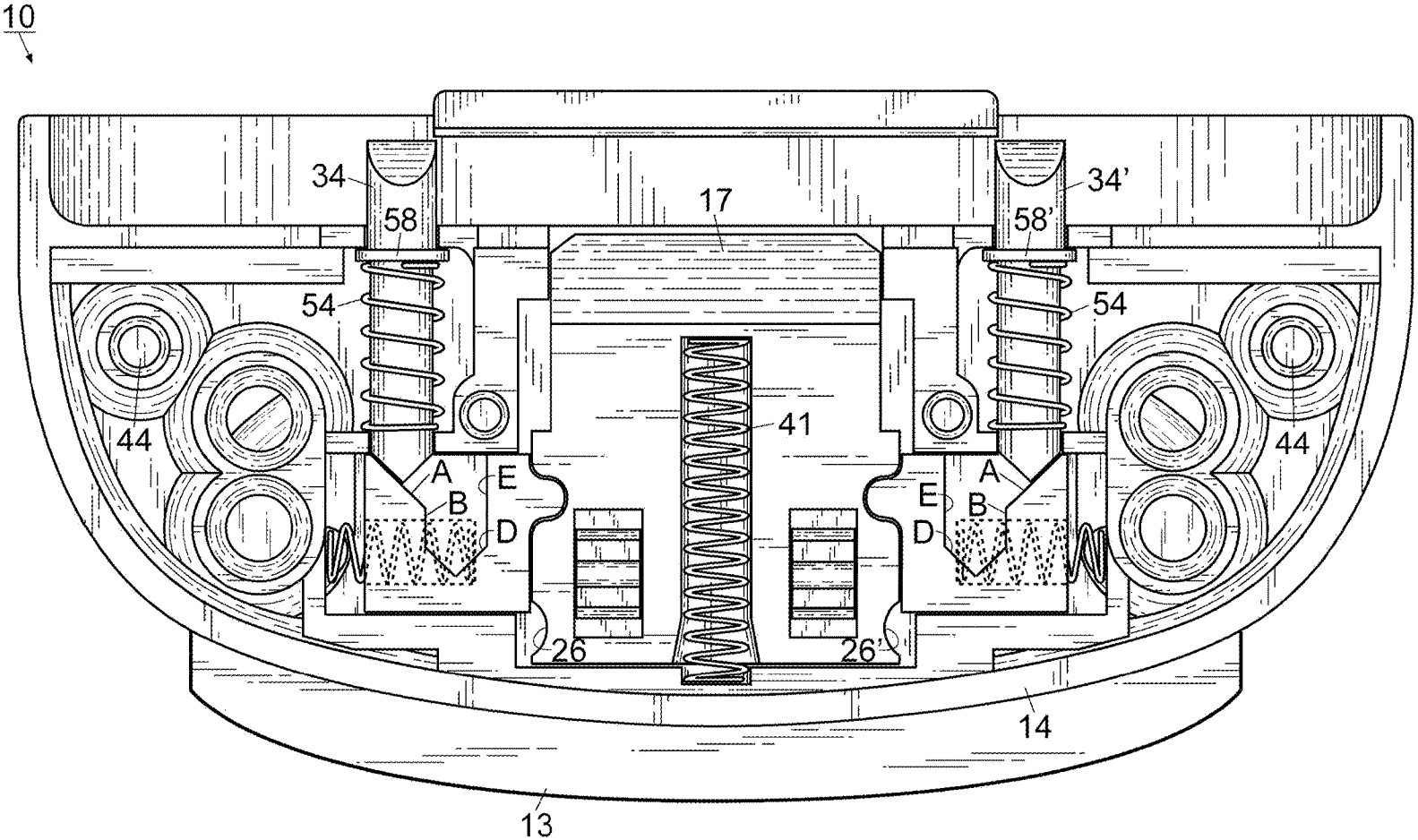
FIG. 4 demonstrates a bottom plan view of the sash lock of FIG. 3 in a retracted orientation.

Bolt 17 has a generally rectangular shape and may define one or more rectangular apertures 21, 21' sized to receive different ones of legs 16, 16' therein. Bolt apertures 21, 21' each include bolt post 22 that extends laterally across the respective apertures (FIG. 3). Bolt posts 22 are received within channels 20 of legs 16, 16' to assist in the transfer of mechanical energy from handle 13 to bolt 17, for example manual urging by a user displacing handle 13 from a first position as shown in FIG. 3 to a second position as shown in FIG. 4 with corresponding bolt displacement. Bolt 17 further includes central channel 61 (FIGS. 2-3) formed in the bottom thereof for receiving and maintaining central resilient member 41, preferably a coil spring.

Figure 5:
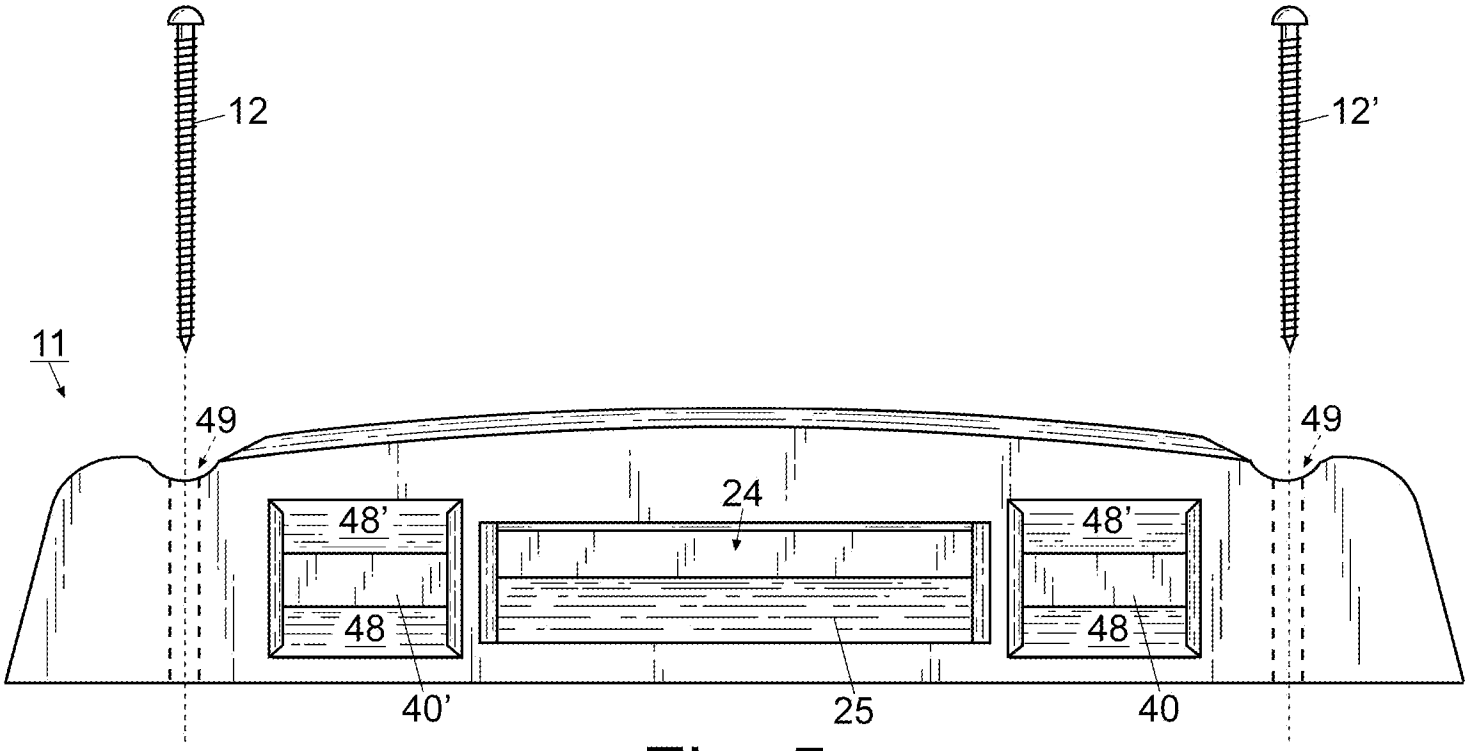
FIG. 5 illustrates a rear elevated view of the sash lock keeper.

Preferred bolt 17 defines biased face 23 for frictionally engaging central bolt aperture 24 defined in keeper 11 (FIG. 5). In use, bolt 17 is positioned within bolt aperture 24 in a first locked position, with the pitch of biased face 23 substantially equaled by channel face 25 of bolt aperture 24. When handle 13 is displaced as described above, bolt 17 is removed from bolt aperture 24 which allows lower sash 8 and sash lock 10 to displace vertically from keeper 11. While biased face 23 and channel face 25 may define any corresponding pitch, the preferred angle is approximately twenty-five degrees (25°). Bolt 17 may also include two pairs of opposingly positioned notches 26, 26', 27, 27' in either longitudinal side of bolt 17 body. For the sake of brevity, only one set of notches 26, 27 may be described, but it should be understood that all descriptions apply equally well to opposing notches 26', 27'.

Couplings 28, 28' define respectively fingers 29, 29' that project outwardly from a side of the coupling body and may have a rounded or arcuate end. Notches 26 and 27 of bolt 17 are each sized to receive finger 29 therein, but notch 27 defines a slightly deeper bore than notch 26. The result of the differing depths between notch 26 and 27 is that finger 29 does not fully seat within notch 26 and is moved therefrom with relative ease, for example when bolt 17 strikes and retracted from keeper 11 upon lower sash 8 returning to the lowered position. However, the increased depth of notch 27 allows for full seating of finger 29 therein and may prevent mere passive frictional displacement of finger 29, for example when it is desirous that bolt 17 be retracted to clear the confines of keeper 11 and handle 13 is displaced from a first to second position as described.

Couplings 28, 28' have a somewhat rectangular shape and preferably define longitudinal groove 30 in one end with the opposing end being planar, and lateral groove 31 on one side with the opposing side defining protruding finger 29. U-shaped lateral groove 31 may be sized to receive resilient member 32, preferably a coil spring, that provides sufficient bias to ensure that finger 29 does not inadvertently disengage from bolt 17 during operation of sash lock 10. Longitudinal groove 30 is defined by a series of planar, angular or biased faces A, B, C, D, E. Faces C and D join to form an opening, for example ninety degrees (90°), to partially receive plunger 34 during operation. Faces A and E may not be contiguous but serve to define a more open angled opening, for example one hundred twenty degrees (120°), for receiving and allowing horizontal displacement of plunger 34 therein as coupling 28 slides from side to side during operation. During use, as bolt 17 is retracted from a first (locked) position (FIG. 3) to a second (unlocked) position (FIG. 4), notch 26 is urged over finger 29 causing coupling 28 to be pushed outwardly compressing spring 32 allowing plunger end 35 to move within groove 30 until finger 29 is received within notch 27 whereby spring 32 decompresses pushing coupling 28 inwardly thereby urging finger 29 to fully seat within notch 27 as seen in FIG. 4 locking bolt 17 in a retracted posture and further extending plungers 34, 34'.

Plungers 34, 34' as seen in FIGS. 2, 3 and 4 each have a generally tubular shaped body for receiving resilient member 54 thereon. Plungers 34, 34' each define vertical end 35 formed from biased faces 36, 36' (FIG. 3) which is positioned opposite and perpendicular to horizontal end 38 formed from biased faces 39, 39' (FIG. 2) which are joined together at midline 37. As shown in FIG. 3, plungers 34, 34' with resilient members 54 are in a relaxed position due to the positioning of couplings 28, 28' with fingers 29, 29' in notches 26, 26' respectively. In this position, vertical biased face 36 of plunger 34 and biased face 36' of plunger 34' are contacting angular faces A of respectively couplings 28, 28', in turn permitting fingers 29, 29' to reside within notches 26, 26'. Handle 13 may then be manually grasped by a user and urged rearwardly away from the window sash, driving bolt 17 to overcome the bias of central resilient member 41 and retract within housing 14, thus urging fingers 29, 29' from respectively notches 26, 26' to transition across a planar portion of bolt 17 and enter notches 27, 27' respectively locking bolt 17 in a retracted posture as seen in FIG. 4. During the movement of bolt 17 and couplings 28, 28', plungers 34, 34' respectively are urged from a relaxed posture as seen in FIG. 3 to a fully extended posture as seen in FIG. 4 as they slide along angular faces A of respectively couplings 28, 28'.

In order to function as an automatically locking sash lock, plungers 34, 34' and resilient members 54 are compressed (retracted within housing 14), for example as plungers 34, 34' are removed from respective plunger apertures 40, 40' (FIG. 5) defined in keeper 11, such as during raising of lower sash 8. As sash 8 is raised biased faces 39' of plungers 34, 34' are guided along keeper 11 thus retracting plungers 34, 34' within housing 14 whereby the force exerted from biased faces 36, 36' on opposing ends 35, 35' against biased faces A in grooves 30 cause couplings 28, 28' to push outwardly thereby allowing fingers 29, 29' to exit notches 27, 27' whereby resilient member 41 decompresses forcing bolt 17 outwardly until fingers 29, 29' seat again within notches 26, 26' respectively as seen in FIG. 3.

During compression plungers 34, 34' frictionally engage and slide along angular faces A and B of longitudinal grooves 30 thus forcing couplings 28, 28' outwardly to overcome the bias of resilient members 32 positioned in lateral grooves 31 of couplings 28, 28'. As couplings 28, 28' move outwardly fingers 29, 29' are extracted from notches 27, 27' thus freeing central resilient member 41 to drive bolt 17 into the extended position and return fingers 29, 29' to notches 26, 26' respectively. This orientation, with bolt 17 extended, is maintained until a mechanical stimulus, such as striking keeper 11 upon the return of lower sash 8 to the lowered position, drives bolt 17 towards the interior of housing 14. This action does not cause sufficient displacement of bolt 17 to allow fingers 29, 29' to engage notches 27, 27', but it does allow bolt 17 to clear keeper 11 before extending and engaging the interior of bolt aperture 24 of keeper 11 thus locking window sashes 6 and 8 without any additional input from a user, such as rotating a handle or throwing a bolt.

Preferred sash lock 10 also includes base plate 42 attachable to the bottom of housing 14 for securing the internal components of sash lock 10 therein. Base plate 42 may define pairs of opposing vertical posts 43 for insertion into respective pairs of corresponding receptacles 44 defined in the underside of housing 14. Plate 42 also defines a pair of plunger cradles 45, 45' that fit within corresponding plunger cradle receivers 55, 55' in housing 14 to form openings which are sized to receive plunger horizontal ends 38 therethrough as seen in FIGS. 3 and 4. Plungers 34, 34' include outwardly extending lips 58, 58' respectively to prevent overextension of plungers 34, 34' through the openings as seen for example in FIG. 4. An embodiment of base plate 42 may define one or more fastener apertures 46, 46', preferably sized to receive threaded fasteners 12 (FIG. 1) such as screws therethrough. While any shape corresponding to fastener 12 employed is contemplated, fastener apertures 46, 46' preferably define a kidney-shaped opening to allow for greater flexibility in positioning and alignment on a window sash rail. Fastener apertures 46, 46' align with apertures 64 (FIG. 3) formed in housing 14 for allowing secure attachment of housing 14 to a window sash. Apertures 46, 46' and 64 allow for fasteners 12 to be hidden as well as providing options to fit any pre-punched or pre-existing fabrications while also covering fasteners 12 with secured handle 13 and cover 15.

An embodiment of sash lock 10 preferably includes keeper 11 as illustrated in FIG. 5 in an elevated rear view. Keeper 11 may define one or more central bolt apertures 24 and a plurality of plunger apertures 40, 40'. Each of apertures 24 and 40, 40' define respectively biased faces 25 and 48, 48' to cooperate with respectively bolt biased face 23 of bolt 17 or plunger biased faces 39, 39' of plungers 34, 34', respectively. Keeper may also include one or more fastener bores 49, 49' to receive threaded fasteners such as fasteners 12 therethrough to secure keeper 11 to lower rail 7 of upper sash 6. In use, keeper 11 is mounted to lower rail 7 with fasteners 12 as is known in the art in cooperative alignment with sash lock 10.

When lower sash 8 is desirous in being vertically displaced, handle 13 is engaged and bolt 17 disassociated from bolt aperture 24 as earlier described and seen in FIG. 4. As lower sash 8 begins to rise, biased faces 39' of plungers 34, 34' contact biased faces 48', overcoming the bias of resilient members 54 and compressing plungers 34, 34' within housing 14. Due to orientation aided by cutouts in housing 14, plungers 34, 34' clear keeper 11 prior to bolt 17 following displacement of finger 29 from notch 27 as previously described, permitting plungers 34, 34' and bolt 17 to resume their relaxed position as seen in FIG. 3. As lower sash 8 is returned to the lowered position for closing, bolt 17 and plungers 34, 34' contact the top of keeper 11, whereby the biased surfaces contact and slide along one another depressing bolt 17 and plungers 34, 34' respectively, before again resuming their extended position within keeper bolt aperture 24 and plunger apertures 40, 40'. The ingress and egress of bolt 17 and plungers 34, 34' from keeper 11 is substantially aided by their respective biased faces 23 and 39, particularly as they correspond with biased faces 25 and 48, 48' within keeper apertures 24 and 40, 40'.

A method for locking a double-hung window with a automatically locking sash lock and keeper includes the steps of providing keeper 11 and mating sash lock 10 with handle 13 and cover 15 attached to housing 14 containing bolt 17 having biased face 23 and a pair of plungers 34, 34', each defining an end with at least one biased face 39 or 39'. Bolt 17 and plungers 34, 34' are in mechanical communication via respectively a pair of couplings 28, 28' that each define lateral grooves 31 for receiving resilient members 32 therein, longitudinal grooves 30 for slideably receiving the body of plungers 34, 34', and fingers 29, 29' for selectively engaging either first notches 26, 26' or second notches 27, 27' formed in opposing sides of bolt 17. Longitudinal groove 30 is formed from angular faces A, B, C, D and E which as seen in FIG. 3 define a wider channel open portion and a slightly narrow channel end portion. Sash lock 10 and keeper 11 are cooperatively positioned on respectively lower sash 8 and upper sash 6, aligning bolt 17 and plungers 34, 34' with respectively corresponding apertures 24 and 40, 40' defined by keeper 11. Both sash lock 10 and keeper are fastened to respective sashes 8, 6 with threaded fasteners 12. For opening of the window, handle 13 is grasped and urged outwardly away from the window to laterally displace causing bolt 17 to disengage keeper 11 by virtue of downwardly depending legs 16, 16' contacting bolt 17 and resulting in resilient member 41 being compressed as fingers 29, 29' (FIG. 3) disengage shallower notches 26, 26' and engage deeper notches 27, 27' as seen in FIG. 4. During such movement, plungers 34, 34' are extended from housing 14 by resilient members 54 as biased faces 36, 36' frictionally engage faces A of longitudinal grooves 30 as couplings 28, 28' are forced outwardly compressing resilient members 32 until fingers 29, 29' are engaged within notches 27, 27' whereby couplings 28, 28' return inwardly by the decompression of resilient members 32 and the force exerted causes plungers 34, 34' to extend outwardly and bolt 17 is locked in a compressed position as seen in FIG. 4.

Upon raising lower sash 8, plungers 34, 34' strike the top of keeper 11 and are resiliently depressed as biased faces 39' of plungers 34, 34' frictionally engage and slide along respective biased faces 48' of apertures 40, 40' thereby depressing downwardly on couplings 28, 28' which each move outwardly compressing resilient members 32 allowing fingers 29, 29' to disengage from notches 27, 27' thus releasing bolt 17. Upon release resilient member 41 decompresses forcing bolt 17 to extend outwardly thus returning fingers 29, 29' to seat within notches 26, 26' returning sash lock 10 to its locking position as seen in FIG. 3.

When it is desirous to return lower sash 8 to its lowered (closed) position, a user grasps and urges lower sash 8 downwardly whereby biased face 23 of bolt 17 and biased faces 39 of plungers 34, 34' frictionally engage and slide overtop keeper 11 to simultaneously depress bolt 17 and plungers 34, 34' until reaching keeper apertures 24, 40, 40' whereby resilient member 41 extends such that bolt 17 slideably engages bolt aperture 24, and plungers 34, 34' engage plunger apertures 40, 40' securely locking sash lock 10 without additional input from a user.

The illustrations and examples provided herein are for explanatory purposes and are not intended to limit the scope of the appended claims.

I claim:

1. A sash lock comprising a housing, a bolt, a plunger defining a pair of opposing ends, said bolt and said plunger positioned within said housing, a coupling defining a groove with a pair of angularly biased faces, said groove complementarily sized and shaped for receiving one of said plunger ends therein, wherein said groove defines a third angularly biased face, the angle of said third biased face different from said pair of angularly biased faces, said bolt in communication with said plunger via said coupling, whereby longitudinal displacement of said plunger produces frictional engagement of said third angularly biased face with one of said plunger ends, resulting in lateral displacement of said coupling until said one of said plunger ends disengages said third angularly biased face and engages said pair of said angularly biased faces.

2. The sash lock of claim 1 wherein said bolt defines a biased face.

3. The sash lock of claim 1 wherein said bolt defines a notch.

4. The sash lock of claim 3 wherein said coupling defines a finger, said finger sized and shaped to be received within said notch, and said notch sized and shaped to receive said finger therein, and wherein said lateral displacement of said coupling results in removal of said finger from said notch.

5. The sash lock of claim 1 wherein one of said plunger ends defines a first pair of angularly biased faces complementarily shaped to said groove pair of angularly biased faces, said opposing plunger end defines a second pair of angularly biased faces, said first and second pairs of plunger end faces in perpendicular orientation relative to one another.

6. The sash lock of claim 1 further comprising a biasing member, said biasing member positioned within said housing and contacting said bolt.

7. An automatically locking sash lock comprising: a housing, a bolt defining a biased face, a plunger defining a pair of opposing ends, said bolt and said plunger positioned within said housing, a coupling defining a groove with a pair of angularly biased faces, said groove complementarily sized and shaped for receiving one of said plunger ends therein, wherein said groove defines a third angularly biased face, the angle of said third biased face different from said pair of angularly biased faces, said bolt in communication with said plunger via said coupling, a keeper, said keeper defining a plurality of apertures, said apertures for receiving different ones of said bolt and plunger, whereby longitudinal displacement of said plunger produces frictional engagement of said third angularly biased face with one of said plunger ends, resulting in lateral displacement of said coupling until said one of said plunger ends disengages said third angularly biased face and engages said pair of said angularly biased faces.

8. The sash lock of claim 7 wherein said bolt defines a pair of notches, one of said notches positioned more proximate to said biased face and defining a depth greater than said other notch.

9. The sash lock of claim 8 wherein said coupling defines a finger, said finger sized and shaped for selective positioning within said pair of notches, said notches sized and shaped for selective reception of said finger therein, and wherein said lateral displacement of said coupling results in the selective positioning of said finger within said respective notches.

10. The sash lock of claim 7 further comprising a handle, said handle positioned on said housing.

11. The sash lock of claim 10 wherein said handle defines a leg, said leg engaging said bolt.

12. The sash lock of claim 10 wherein said handle defines a pair of downwardly depending legs, each of said legs defining a pair of opposing lips, said pairs of opposing lips engaging said bolt.

13. The sash lock of claim 7 further comprising a base plate, said base plate defining a vertical post, said vertical post for positioning within said housing.

14. The sash lock of claim 7 wherein one of said plunger ends defines a first pair of angularly biased faces complementarily shaped to said groove pair of angularly biased faces, said opposing plunger end defines a second pair of angularly biased faces, said first and second pairs of plunger end faces in perpendicular orientation relative to one another.

15. An automatically locking sash lock comprising, a polymeric housing defining a lip, a recess sized and shaped to receive a handle, said handle defining a pair of downwardly depending legs, each leg formed by a leg body defining a central channel and a pair of opposingly oriented leg lips extending therefrom, a bolt defining a biased face and a pair of notches, one of said notches positioned more proximate to said biased face and having a depth greater than said other notch, said bolt also defining a pair of apertures sized and shaped for receiving different ones of the handle legs therein, each aperture including a laterally extending bolt post oriented for insertion within the respective leg central channel, a plunger defining a pair of opposing ends, one of said plunger ends defines a pair of angularly biased faces, said opposing plunger end defines a pair of angularly biased faces, said pairs of plunger end faces in perpendicular orientation relative to said opposing end, whereby said bolt and said plunger positioned within said housing, a coupling defining a first groove with a pair of angularly biased faces, said groove complementarily sized and shaped for receiving one of said plunger ends therein, wherein said groove defines a third angularly biased face, the angle of said third biased face different from said pair of angularly biased faces, and a second groove oriented in perpendicular fashion to said first groove, said second groove sized and shaped to receive a spring therein, whereby said bolt is in communication with said plunger via said coupling, and a base plate, said base plate defining a vertical post, said vertical post for positioning within said housing, wherein the keeper defines a plurality of apertures, said apertures for receiving different ones of said bolt and plunger, and wherein displacement of said plunger causes displacement of said bolt.

* * * * *